US008317160B2

(12) United States Patent
Romo et al.

(10) Patent No.: US 8,317,160 B2
(45) Date of Patent: Nov. 27, 2012

(54) RESTRAINT DEVICE FOR TRACTION SHEAVES

(75) Inventors: David Arevalo Romo, Bonney Lake, WA (US); Christopher Gavin Brickell, Renton, WA (US); John Jerome Haigh, Fircrest, FL (US)

(73) Assignee: Safeworks, LLC, Norwalk, CT (US)

( * ) Notice: Subject to any disclaimer, the term of this patent is extended or adjusted under 35 U.S.C. 154(b) by 626 days.

(21) Appl. No.: 11/871,890

(22) Filed: Oct. 12, 2007

(65) Prior Publication Data

US 2009/0095574 A1 Apr. 16, 2009

(51) Int. Cl.
*B66D 1/36* (2006.01)

(52) U.S. Cl. ..... 254/333; 188/65.4; 254/390; 254/411; 187/409; 182/142

(58) Field of Classification Search ..... 254/134.3 R, 254/2 B, 8 B, 333, 270, 277; 187/409; 474/140, 474/144, 151; 182/142, 5, 191–193, 71, 182/72; 188/65.1–65.5
See application file for complete search history.

(56) References Cited

U.S. PATENT DOCUMENTS

| | | | | |
|---|---|---|---|---|
| 3,586,125 A * | 6/1971 | Durand | 182/92 |
| 3,587,516 A * | 6/1971 | Wainscott | 16/208 |
| 4,193,311 A | 3/1980 | Rinio | 74/230.5 |
| 4,316,602 A | 2/1982 | Desplats | 254/270 |
| 4,681,301 A * | 7/1987 | Rinio | 254/333 |
| 4,706,940 A | 11/1987 | Harig | 254/333 |
| 5,082,248 A | 1/1992 | Harig | 254/333 |

FOREIGN PATENT DOCUMENTS

| | | |
|---|---|---|
| EP | 0734995 A1 | 10/1996 |
| KR | 20020071103 A | 9/2002 |

OTHER PUBLICATIONS

Roberts, Donna, Intuitive Notion of Rotational Symmetry; Oswego City School District Regents Exam Prep Center undated; 3 pages; downloaded from http://regentsprep.org/Regents/math/geometry/GT1a/Rsymmet.htm.*

* cited by examiner

*Primary Examiner* — Katherine W Mitchell
*Assistant Examiner* — Daniel Cahn
(74) *Attorney, Agent, or Firm* — Woodcock Washburn LLP

(57) ABSTRACT

A restraint device is disclosed that limits the movement of the cable or rope relative to the traction, thus reducing or eliminating the popping noise associated with the cable or rope snapping back against the traction sheave. In one embodiment, the restraint device comprises a molded component that is fitted to encompass the region of the sheave where separation of the wire rope from the sheave is most likely to occur. The restraint device may be mounted so that it is removable and replaceable with minimal dismantling of the hoist containing the sheave. The restraint device may be reversible so that one restraint device may by used for at least two cycles before being replaced. Indication of the need for replacement may be provided by including a second color material at the depth where wear reaches the allowable limit, thereby providing a visual signal to initiate replacement as seen during service.

7 Claims, 10 Drawing Sheets

RESTRAINT DEVICE FOR TRACTION SHEAVES

BACKGROUND

Traction sheaves are used in a variety of load-lifting applications such as elevated platforms for building maintenance. Such a platform can be used in conjunction with a motorized hoisting device, whereby the hoisting device is attached to the platform of an elevated platform or basket that may then be raised or lowered using the hoisting device. The hoisting device and associated rigging typically comprises a traction sheave, whereby the load of a continuous cable or rope passes through the sheave.

The traction sheave is generally designed to operate with significant tension in the cable or rope encircling the sheave. One characteristic of traction sheaves and in particular the single sheave "V" groove type is that the cable or rope's points of contact with the sheave may have different radii at different positions around the sheave. As a result, the velocity of the wire rope may vary according to the instantaneous radius at which each point is in contact with the sheave. Consequently, the wire rope will tend to be either tensioned or bunched as adjacent portions of the wire rope are at lesser or greater radii than the average radius around the traction sheave.

At the points where the traction sheave contacts the cable or rope, friction creates driving tension in the cable or rope. Generally the wire rope will tend to bunch in a known region of the sheave. When sufficient wire rope has bunched and laterally lifted off the tension sheave, the friction between the sheave and wire rope in that region decreases to the point where the tensioned cable or rope may slip or develop slack. The cable or rope may then tighten under the applied load and suddenly resume full contact and friction with the sheave. This event may produce a loud and objectionable popping impulse noise generated when the cable or rope snaps back against the traction sheave. Generally, the tendency to generate the popping noise increases with a poorly maintained dry, non-lubricated cable or rope as the incidence of the bunching may increase.

Several methods of restraining wire rope movement relative to the traction sheave on traction hoists are known. For example, U.S. Pat. No. 4,681,301 discloses a series of rollers restraining the wire rope to the proximity of the sheave groove. U.S. Pat. No. 5,082,248 discloses a segment of rollers restraining the wire rope to the proximity of the sheave groove. U.S. Pat. No. 4,706,940 discloses a pair of rollers restraining the wire rope to the proximity of the sheave groove. A disadvantage of the above disclosed methods is the generally increased cost and complexity in implementing the disclosed devices, and the potential for an increased incidence of rope jams.

Other methods of restraining wire rope displacement relative to the traction sheave have been developed such as that disclosed in U.S. Pat. No. 4,193,311. However, the method disclosed performs a function different to the situation described above. What is needed is a restraint assembly that can reduce or eliminate the lateral rope or cable movement that can result in the objectionable popping noise, and can further be easily removed and replaced without excessive disassembly of the hoisting device and traction sheave and the removal of the lines, ropes or cables.

SUMMARY OF THE INVENTION

In various embodiments, a restraint device is disclosed that limits the lateral movement of the cable or rope relative to the traction sheave, thus reducing or eliminating the popping noise associated with the cable or rope snapping back against the traction sheave. The disclosed restraint device further provides the features of low cost, low wear, and simple removal and replacement.

In one embodiment, the restraint device comprises a molded component which is fitted to encompass the region of the traction sheave where the separation of the cable or rope from the traction sheave is most likely to occur. The restraint device may be mounted so that it is removable and replaceable with minimal dismantling of the hoist and rigging associated with the sheave. In a further embodiment, the restraint device may be symmetrical and reversible or rotatable such that one restraint device may be used for two or more life cycles before being replaced. Abrasion and wear of the restraint device is minimized by allowing a small space between the cable or rope and the restraint device, thereby minimizing contact with the restraint device without increasing the incidence of wire rope jams.

Because the restraint device has no moving parts, contamination from the wire rope does not adversely affect the device's function in eliminating popping as compared to a roller type system in which contamination from corrosives or particulates may more easily accumulate. Where contaminants are present in and around the traction sheave, a further feature of the disclosed restraint device is that abrasion with the cable or rope may provide a self cleaning function.

In another embodiment, indication of the need for replacement is provided by including a second color material at the depth where wear reaches an allowable limit, thereby providing a visual signal to initiate replacement as can be observed during service and maintenance. Alternatively, by placing a hole transversely in the molding at the position of maximum wear, when the wear reaches the hole, the hole will break through and the wear limit will be signaled as a break in the wire rope track.

BRIEF DESCRIPTION OF THE DRAWINGS

The foregoing summary, as well as the following detailed description of preferred embodiments, is better understood when read in conjunction with the appended drawings. For the purposes of illustration, there is shown in the drawings exemplary embodiments; however, the present disclosure is not limited to the specific methods and instrumentalities disclosed. In the drawings.

DETAILED DESCRIPTION

Figure 1:
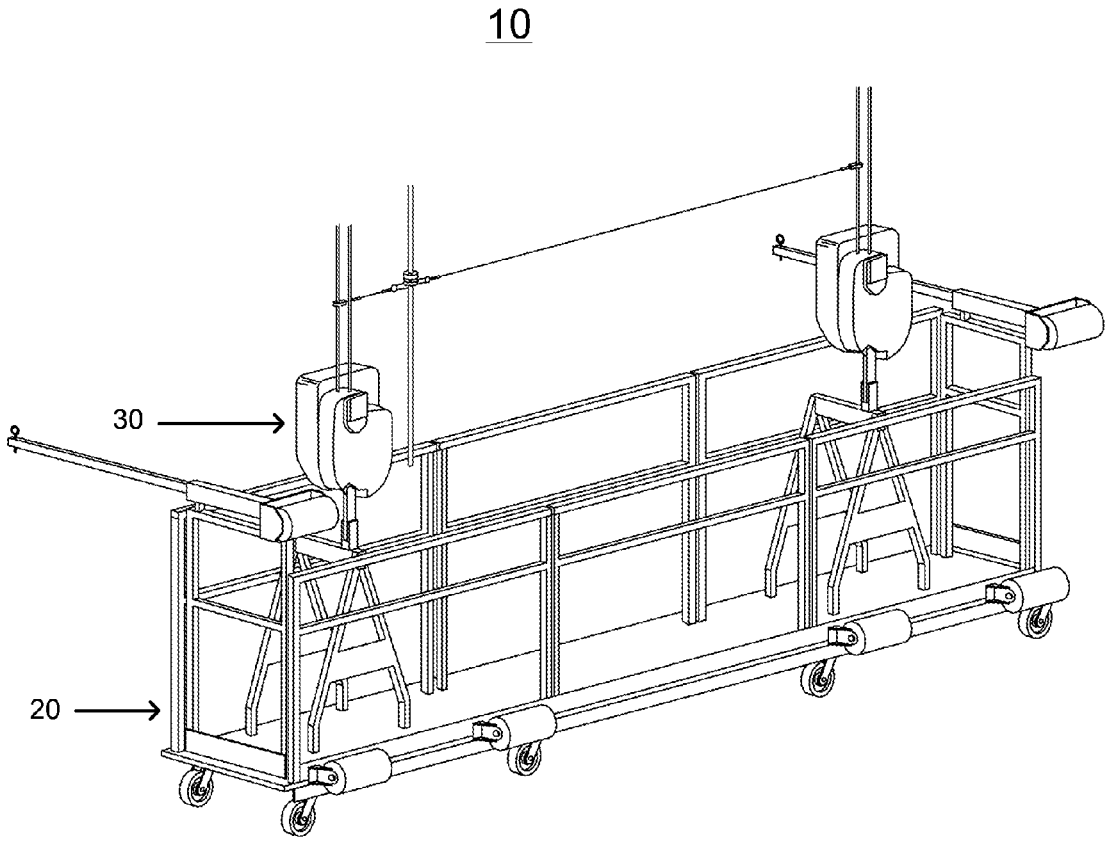
FIG. 1 is a diagram illustrating an example apparatus in which aspects of the described embodiments may be incorporated.

It is to be understood that the embodiments disclosed herein are not limited in application to the details of construction and the arrangement of components set forth in the following description or illustrated in the drawings. The disclosure is capable of other embodiments and of being practiced or being carried out in various ways. Also, it is to be understood that the phraseology and terminology used herein is for the purpose of description and should not be regarded as limiting.

The present disclosure relates to the production and service of hoisting devices used to elevate platforms or baskets typically associated with large structure service and maintenance, such at buildings, bridges, towers, and the like. In particular, the disclosure relates to a restraint device used in conjunction with a traction sheave that may be used with a hoisting device. FIG. 1 depicts an exemplary platform apparatus 10 for supporting at least one person and associated work equipment. As shown in the figure, a platform 20 can be a flat surface, scaffolding, basket or cabin. The platform is of sufficient size to carry at least one worker and work equipment. In some embodiments, the platform 20 can support a plurality of workers. The platform is typically coupled to at least one powered hoisting device 30 such that the platform can be elevated or lowered in the vertical dimension. The platform may be further secured with safety lines and guidelines. When maintaining or constructing structures of various kinds, a platform apparatus of this kind provides transport of personnel and materials to and from the various landings of the structure. For example, the platform may be move vertically along stacked mast tower sections. The platform apparatus may also be used for work on various elevated areas of the structure. Such a platform is commonly used on large scale construction projects, such as high-rise buildings and other large structures. A platform such as that described may carry personnel and materials quickly between the ground and higher floors, or between upper floors or act as a platform for working on the curtain wall or other structures of the building.

For controlled travel, platforms typically utilize a motorized hoisting device. A hoist is a device used for lifting or lowering a load by means of a drum or lift-wheel around which a rope or chain wraps. FIG. 1 depicts an exemplary hoisting device 30 that may be used to elevate a platform or basket. The hoist may be manually operated, electrically or pneumatically driven and may use chain, fiber or other types of rope as its lifting medium. The lifting medium is typically wrapped around a traction sheave and raised by the traction sheave with a special profile to engage the cable or rope. The powered type hoist can be either electric motor or air motor. A hoist can be built as one integrated package unit or it can be built as a built-up custom unit.

Figure 2:
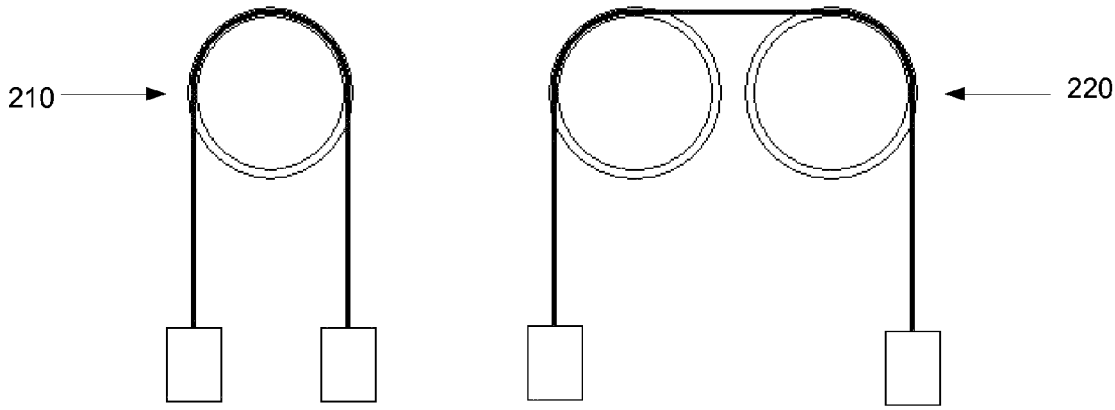
FIG. 2 is a diagram illustrating various examples of traction sheaves.
Figure 4:
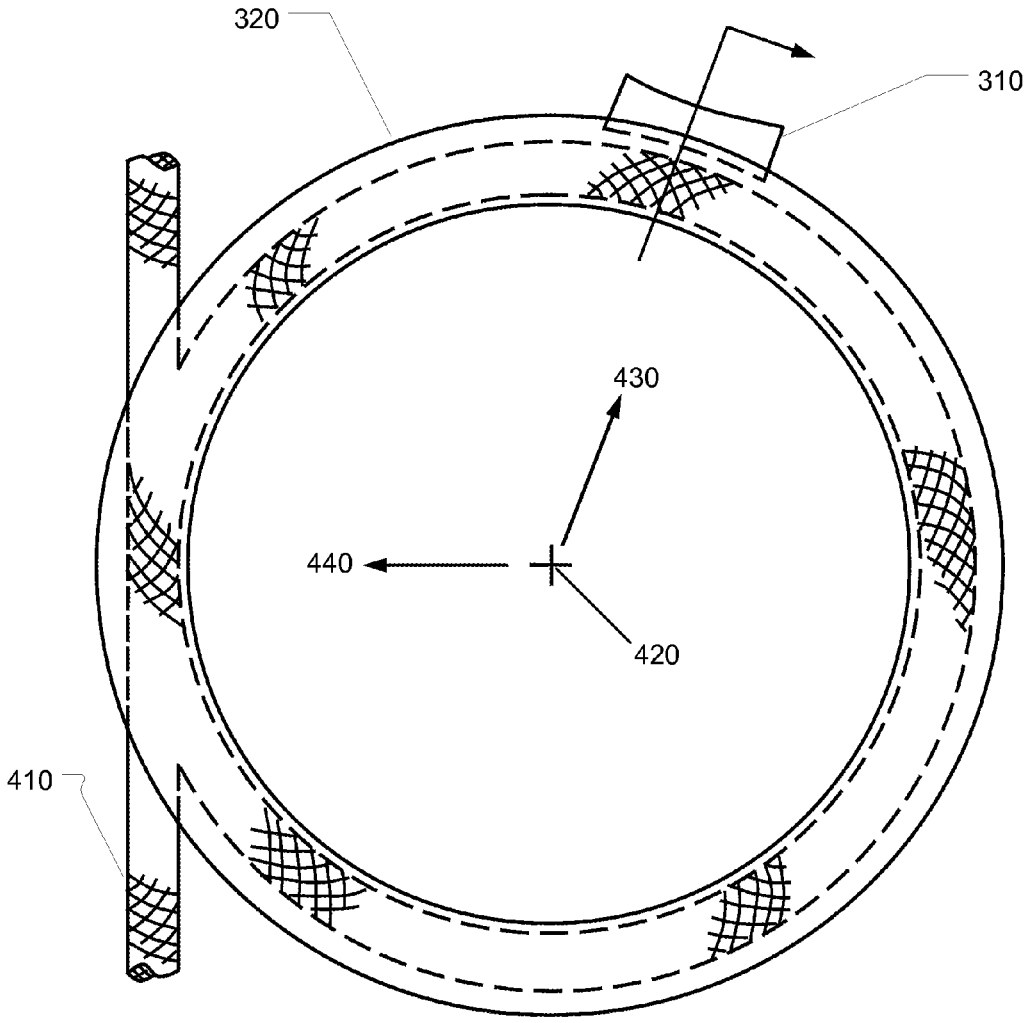
FIG. 4 is a diagram illustrating an embodiment depicting the positional relationship of the wear block to the cable or wire in the sheave.

A traction sheave is typically a wheel with a groove between two flanges around its circumference. The groove normally guides a rope, cable or belt. Traction sheave are used to change the direction of an applied force, transmit rotational motion, or realize a mechanical advantage in either a linear or rotational system of motion. FIG. 2 depicts two examples of traction sheaves. Sheave 210 illustrates a sheave with a half turn, and sheave 220 illustrates a sheave with a quarter turn. FIG. 4 (discuss further below) illustrates a sheave 320 with a full turn.

As mentioned above, traction sheaves are used in a variety of load-lifting applications such as elevated platforms for building maintenance. The traction sheave is generally designed to operate with significant tension in the cable or rope encircling the sheave. One characteristic of traction sheaves and in particular the single sheave "V" groove type is that the cable or rope's points of contact with the sheave may have different radii at different positions around the sheave. As a result, the velocity of the wire rope may vary according to the instantaneous radius at which each point is in contact with the sheave. Consequently the wire rope will tend to be either tensioned or bunched as adjacent portions of the wire rope are at lesser or greater radii than the average radius of around the sheave.

At the points where the sheave contacts the wire rope, friction creates driving tension in the cable or rope. Generally the cable or rope will tend to bunch in a known region of the sheave. When a sufficient length of cable or rope has bunched and laterally lifted off the sheave, the friction between the sheave and wire rope in that region decreases to the point where the tensioned wire rope may slip or develop slack. The cable or rope may then tighten under the applied load and suddenly resume full contact and friction with the sheave. This event may produce a loud and objectionable popping impulse noise generated by the cable or rope snapping back against the traction sheave. Generally the tendency to generate the popping noise increases with a poorly maintained dry, non-lubricated cable or rope. Furthermore, the popping noise may occur with sheaves carrying full, half, or quarter turns.

In one embodiment of the present disclosure, a restraint device is disclosed that comprises a molded component fitted to encompass the region of the sheave where separation of the cable or rope from the sheave is most likely to occur. The restraint device may be mounted to the associated hoist or rigging such that it is removable and replaceable with minimal dismantling of the hoist containing the sheave. In a further embodiment, the restraint device may be reversible or rotatable so that one restraint device may by used for at least two cycles before being replaced. Wear of the restraint device may be minimized by allowing a small space between the wire rope and the restraint device, thereby minimizing contact with the restraint device without increasing the incidence of wire rope jams.

The disclosed restraint device may be designed with no moving parts, thus providing advantageous features compared to a restraint system comprising a roller system. For example, a roller system may collect contamination from corrosives, errosives, and other particles from the cable or rope and the associated environment. By eliminating moving parts, the restraint device of the present disclosure may thus avoid such contamination and other effects of foreign particles. Where contaminants are present and have adhered to the device, a further feature of the disclosed restraint device is that continuous contact and/or abrasion with the wire rope may provide a self cleaning function.

In yet another embodiment, indication of the need for replacement may be provided by providing a visual marking at a suitable position on the restraint device where the wear reaches an allowable limit. Such a marking may provide a visual signal to indicate that a replacement is needed in a manner that can be readily observed during normal service of the hoist. For example, a second color material may be used to indicate the wear limit. Alternatively, a hole may be placed transversely in the molding of the restraint at the position of maximum wear. Thus, when the wear reaches the proximity of the edge of the hole, the restraint may break through and the wear limit will be signaled as a break in the wire rope track.

Figure 3:
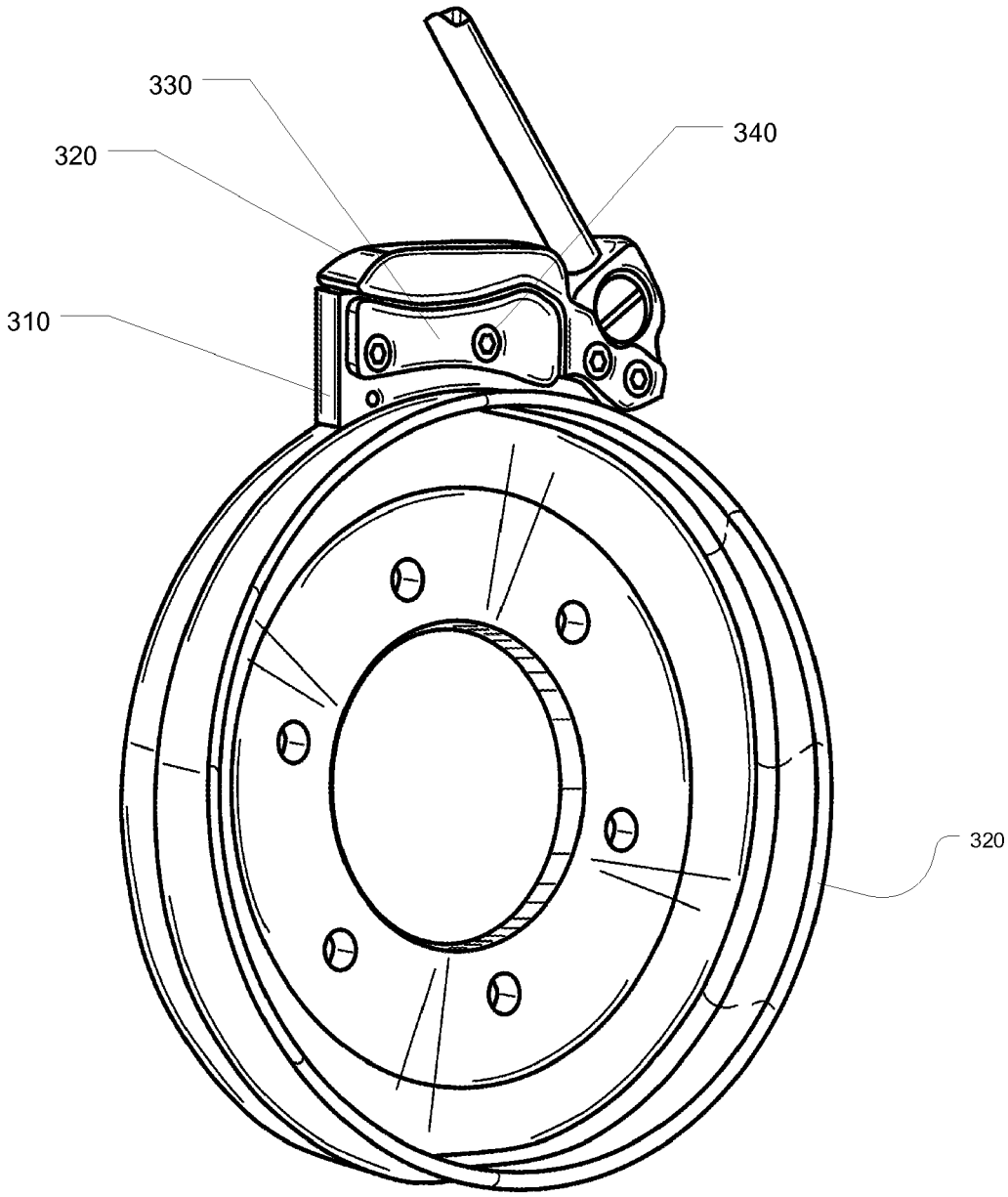
FIG. 3 is a diagram illustrating an embodiment depicting the positional relationship of the restraint device to a traction sheave.

FIG. 3 depicts an exemplary restraint device wear block 310 located in the proximity of a traction sheave 320. The traction sheave 320 typically guides a cable or rope around the circumference of the sheave along a groove that provides continuous engagement of the cable or rope.

Referring to FIG. 4, cable or rope 410 encircles the groove of the traction sheave 320 depicted in FIG. 3. The objective of the restraint device is to prevent the wire rope from lifting off the sheave beyond a predetermined distance while operating in the typical application in which lifting would normally occur. As described above, such lifting typically leads to a loud popping noise as the wire rope slips in the sheave and snaps back to resume normal full-groove contact.

Referring back to FIG. 3, the wear block 310 is held in place between the wear block holder 320 and wear block retaining plate 330 using a screw connection 340. The wear block 310 is located such that an inner groove of the wear block allows for movement of the rope 410 through the traction sheave 320 during typical operation.

Figure 5:
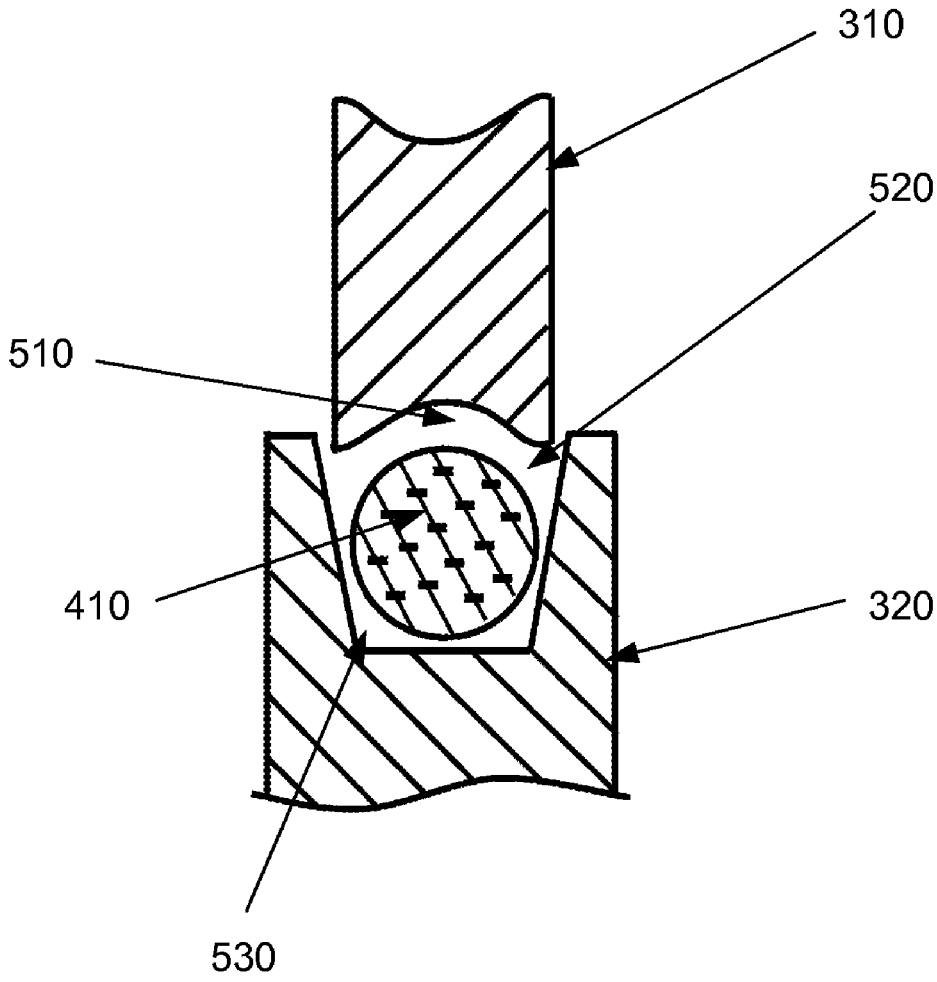
FIG. 5 is a diagram illustrating a cross-sectional view of an embodiment depicting the positional relationship of the wear block to the wire rope in the sheave.

FIG. 5 depicts a cross-sectional view of the restraint assembly depicted in FIGS. 3 and 4. Referring to FIG. 5, the wear block 310 is located such that an inner groove is separated from the normal position of the cable or rope 410 under normal operating tension by a small distance 510. Distance 510 is selected such that for operational positioning of the cable or wire 410, the outer radius of cable or wire 410 will not be in continuous contact with wear block 310 while preventing the lateral displacement and/or bunching of the cable or wire 410 from the traction sheave 320.

In one embodiment, wear block 310 may be contoured to approximate the contour of said cable or wire 410 encircling sheave 320. It should be noted that such contouring is not required and the wear block may provide a flat or other surface. When cable or wire 410 lifts off sheave 320, a force will be applied to cable or wire 410 to restrain its radial movement and thereby limit the snap-back distance of cable or wire 410 to substantially reduce or eliminate the intensity of the popping noise.

The radial position of wear block 310 relative to cable or wire 410 may be chosen to limit the duration of contact with cable or wire 410 except when lifting occurs. Typically, wear block 310 will experience some wear during initial use, and will also experience wear when a larger diameter wire rope (for example, an 8.2 mm rope) replaces a smaller diameter wire rope (for example, an 5/16 inch rope). Additionally, the position of the cable or wire rope in the sheave groove 520 may change during the course of continued use as the tension and condition of the cable or rope varies.

The continuous maintenance of the cable or rope may generally be inadequate to prevent some degree of corrosion, thus leading to abrasive rust being formed on the cable or rope. As a result, depending upon the level of maintenance of the cable or rope, the abrasive potential may vary. Furthermore, as the cable or rope is used over a long period of time, the wear and/or ovality (i.e., the degree of deviation from circularity of the cross section of the cable or rope) may increase and potentially result in contact with the wear block 310. Because of the reasons described above, wear block 310 may be constructed of an abradable material that can abrade in preference to abrading and damaging the cable or rope. Thus, when the wear block 310 rubs against the wire or rope, the wear block 310 will be worn whereas the wire or rope may experience little or no wear.

Referring back to FIG. 3, wear block 310 may be held in place between the wear block holder 320 and wear block retaining plate 330 using connection means, preferably using screws. Referring to FIG. 4, wear block retaining plate 310 may be held in a fixed position relative to the sheave central axis 420, thereby maintaining a constant position relative to the sheave. Referring to FIG. 5, maintaining a fixed position relative to the sheave central axis further limits the displacement of the cable or wire from the sheave groove 530, and the wear surface on wear block 310 may be positioned such that the surface is nominally tangential to the wire rope surface.

The circumferential position of wear block 310 may be chosen at a position where maximum lifting typically occurs. As depicted in FIG. 4, such a position may nominally be the one o'clock position 430 when the cable or rope entry-exit point is at the nine o'clock position 440. In some cases it may be advantageous to place the position wear block 310 in different positions to accommodate different applications and cable or rope movement patterns. In other cases, different dimensions for the wear block 310 may be desired. Furthermore, in some applications a plurality of wear blocks 310 may be placed around the circumference of the sheave. The present disclosure should not be limited to any particular wear block shape or a particular number of wear blocks. Various configurations and numbers of wear blocks may be used to accommodate any type of traction sheave and associate rigging. It is also noted that practical trials under a range of cable and rope conditions and tensions have indicated that in many cases the positioning depicted in FIG. 4 provides sufficient limiting of cable/wire movement and may be useful in many applications.

Figure 6:
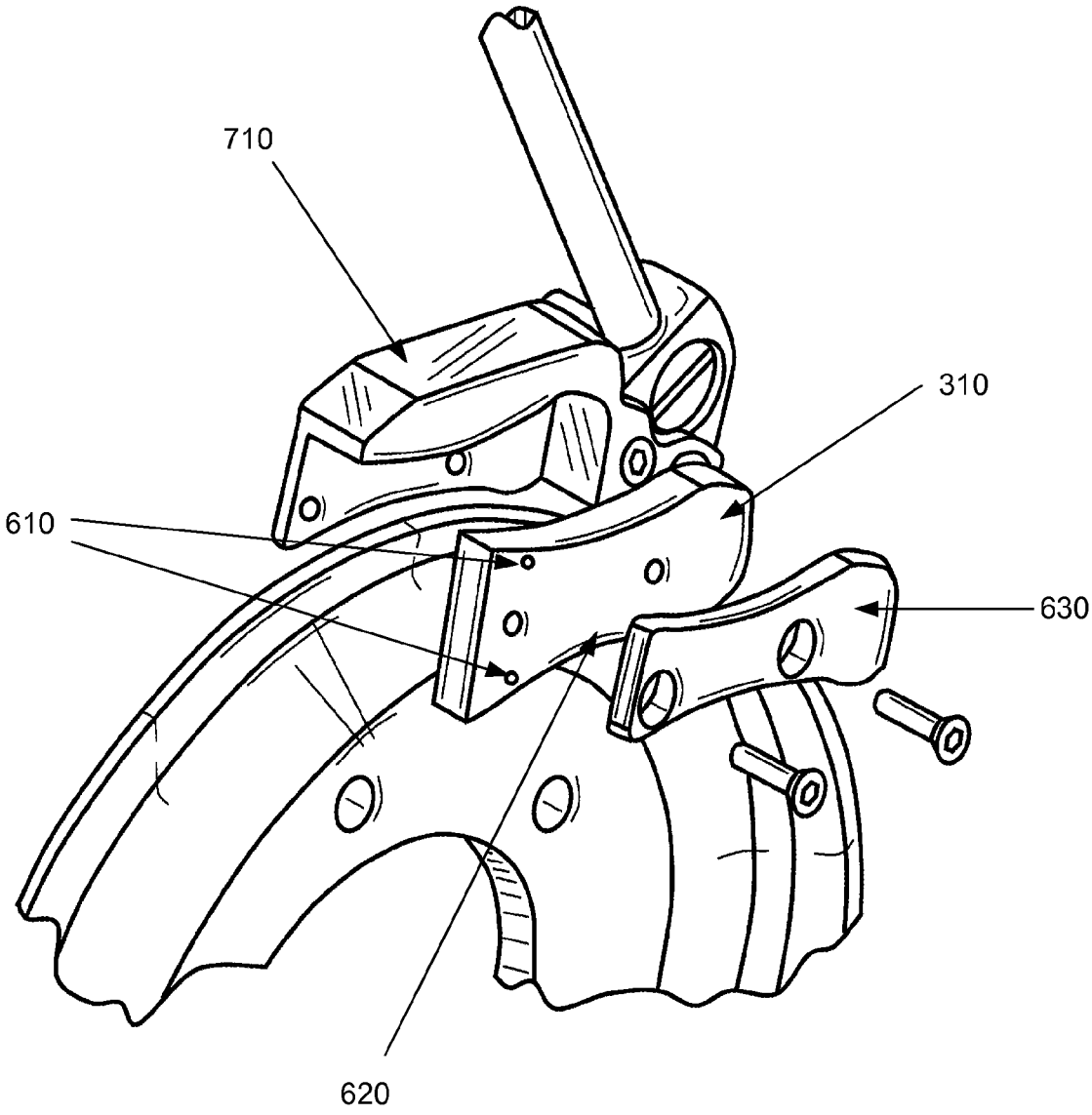
FIG. 6 is a diagram illustrating an embodiment depicting the components associated with the restraint device.

FIG. 6 depicts an exploded view of the various components comprising a restraint device in a traction sheave environment. Referring to FIG. 6, wear block 310 may include a wear indicator comprised of indicator holes 610 extending through the wear block's narrow dimension. Holes 610 are positioned such that as wear surface 620 continuously contacts a cable or rope, thus resulting in the wear and abrasion of the wear block material, the indicator holes 610 gradually becomes exposed within the wear surface and thereby provides an indication that the block should be replaced in order to operate in the desired manner. Indicator holes 610 may be positioned at the point of wear block 310 generally representative of the highest likelihood of wear.

In another embodiment, the wear indicator may be provided by molding wear block 310 with different colored materials wherein the wear indicator position may be marked with a visually distinct color or point of color transition. When wear block 310 wears to the position indicated by the alternative coloration, visual inspection may reveal that sufficient wear has occurred indicating the need for replacement. Alternatively, the wear indication may be provided by inserting or attaching different colored material on the wear block 310. In other embodiments, other methods of wear detection may be implemented such as including a thin wire in the molding that carries an electrical current, the wire being coupled to a monitoring device or other suitable means for monitoring wear indication. When sufficient wear has taken place, the wire will break, thus altering or opening the electrical signal to the monitoring device. Alternatively, the wire may not carry an electrical current and may be mechanically coupled to maintain spring tension with a monitoring device. When sufficient wear has taken place, the wire will break and thus mechanically release the wire, thus providing a mechanical indication of wear.

Typically, providing indicator holes 610 will provide a low cost wear indication as compared to the other embodiments described above. It should be noted that local or national rules or regulations may require inspections of the associated rigging or hoisting device at specified intervals. Although the embodiments disclosed herein do not affect the safety of the hoist and is provided to limit the popping noise described above, during such an inspection the indicator hole may provide a convenient visual indication of wear as the cylinder of the hole becomes visible on the wear surface. Alternatively, other visual wear indicators can provide similar visual cues.

Figure 7:
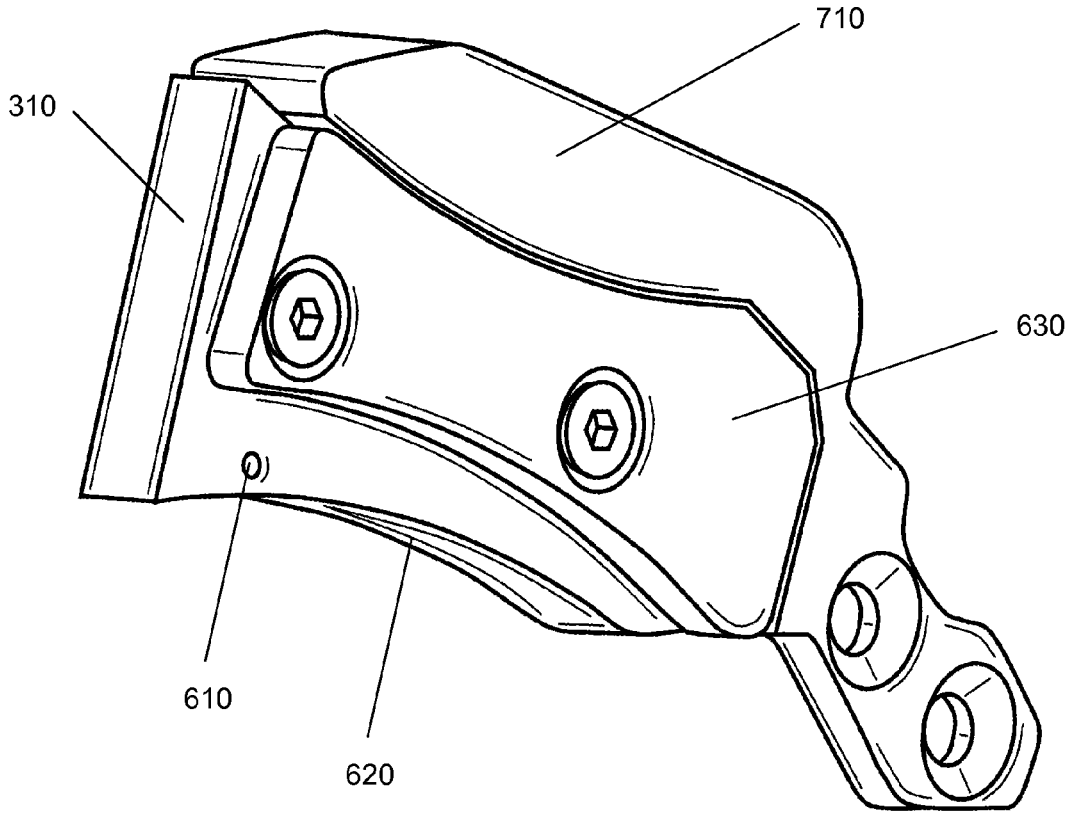
FIG. 7 is a diagram illustrating an embodiment of restraint device including the wear hole indicator.

Referring to FIG. 7, illustrated is the shape of the wear block 310 as mounted on a wear block holder 710. By designing the wear block 310 to be symmetrical about the longer (longitudinal) axis and suitably shaping the wear block holder 710, wear block 310 may be inverted and rotated in wear block holder 710 about the longer axis to provide two wear surfaces 620. In one embodiment, when a first wear surface has worn to the point where replacement is indicated, the wear block may be rotated 180 degrees about the longer axis to provide an additional wear surface for further service. Such a design may therefore double the useful life of the wear block before the entire wear block must be replaced.

Wear indicator holes 610 may be positioned relative to the wear surfaces in order to provide its wear indication function regardless of the specific orientation of the wear block. In a further embodiment, wear block 310 may be shaped such that both longitudinal ends are symmetrically shaped, providing the further possibility that an end-for-end rotation may change the position of the leading edge relative to the holder 710 and thus offer two further uses of the wear block before wear block replacement is required. Note that a multiplicity of wear indicator holes may be disposed along any wear surface.

Figure 8:
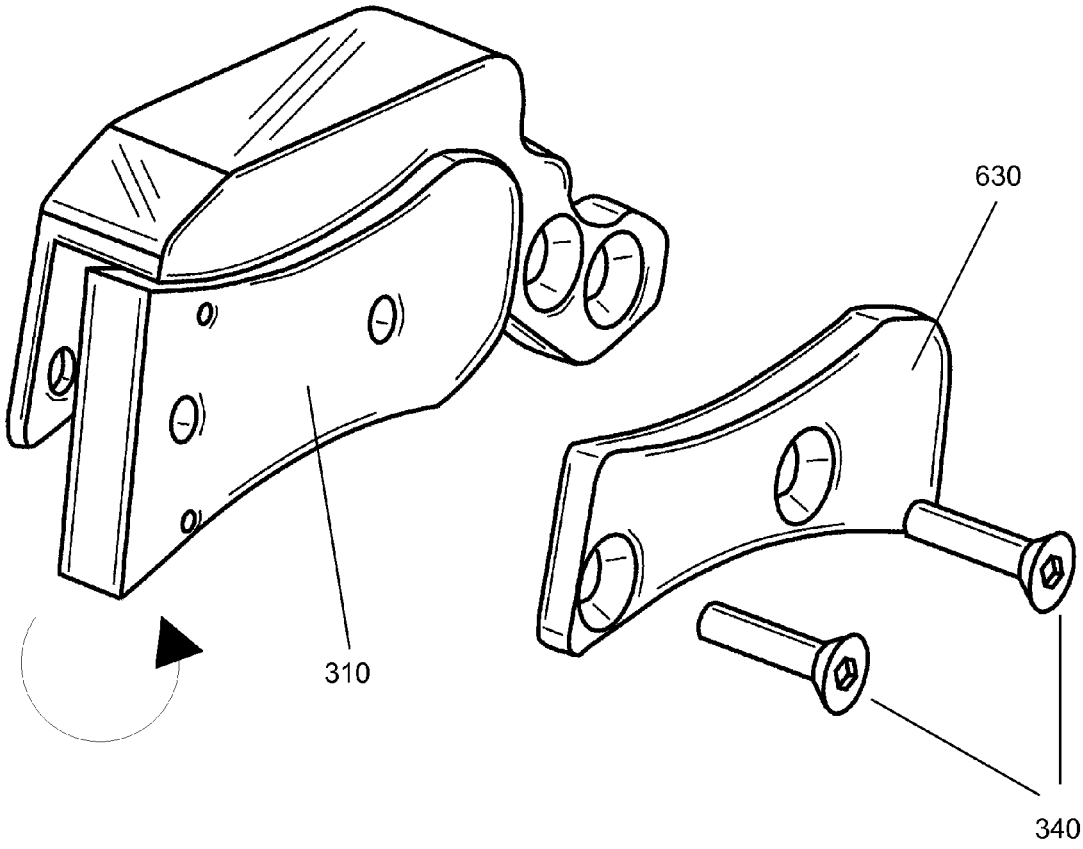
FIG. 8 is a diagram illustrating an embodiment depicting the reversible feature of the wear block.

FIG. 8 illustrates an exploded view depicting one embodiment of a method for the removal and replacement of wear block 310. Referring to FIG. 8, screws 340 may be removed, allowing for the further removal of wear block retaining plate 630. Wear block 310 may then be separated from restraint wear block holder 710 and rotated 180 degrees in the direction shown. Wear block 310 may then be placed against weal block holder 710, held in place by re-positioning wear block retaining plate 630, and re-inserting and tightening screws 340 to secure the entire assembly.

As a further feature of the present disclosure, wear block 310 may be replaced in the wear block holder with a minimum of disassembly of the hoisting device, traction sheave and associated rigging. Replacement or rotation of the wear block 310 does not typically require removal of the traction sheave or de-reeving of the cable or rope from the traction sheave. Furthermore, installation or removal of the wear block does not typically require special tools, thereby minimizing maintenance time and cost, and maximizing availability of the hoisting device.

Figure 9:
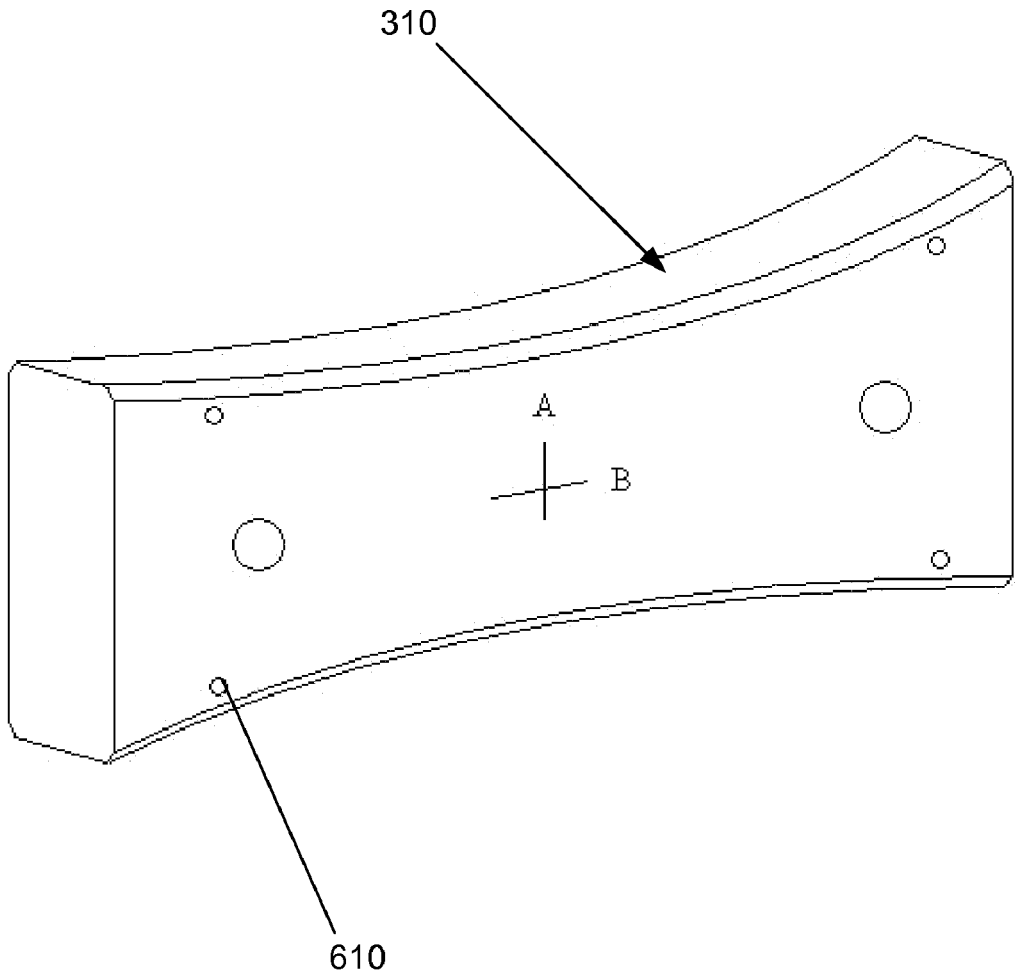
FIG. 9 is a diagram illustrating an embodiment depicting the rotatable feature of the wear block.

In another embodiment, the wear block may further be symmetrical about both the shorter and longer axes and mounted in a similarly shaped wear block holder to provide two additional uses of the wear block. FIG. 9 depicts one embodiment of a wear block that is rotatable to provide a total of four wear cycles. In the figure, wear block 310 with wear holes 610 is shown with two axes A and B. By rotating the wear block 180 degrees about the B axis, a second surface may be provided for an additional wear cycle. Since the nature of the wear is predominantly at the entry point at the left edge of the wear block 310 as shown in the figure, the wear block may further be rotated 180 degrees about the A axis, thus providing the other leading edge for a third wear cycle. Finally, the wear block may again be rotated 180 degrees about the B axis to provide a fourth edge for a fourth wear cycle.

Figure 10:
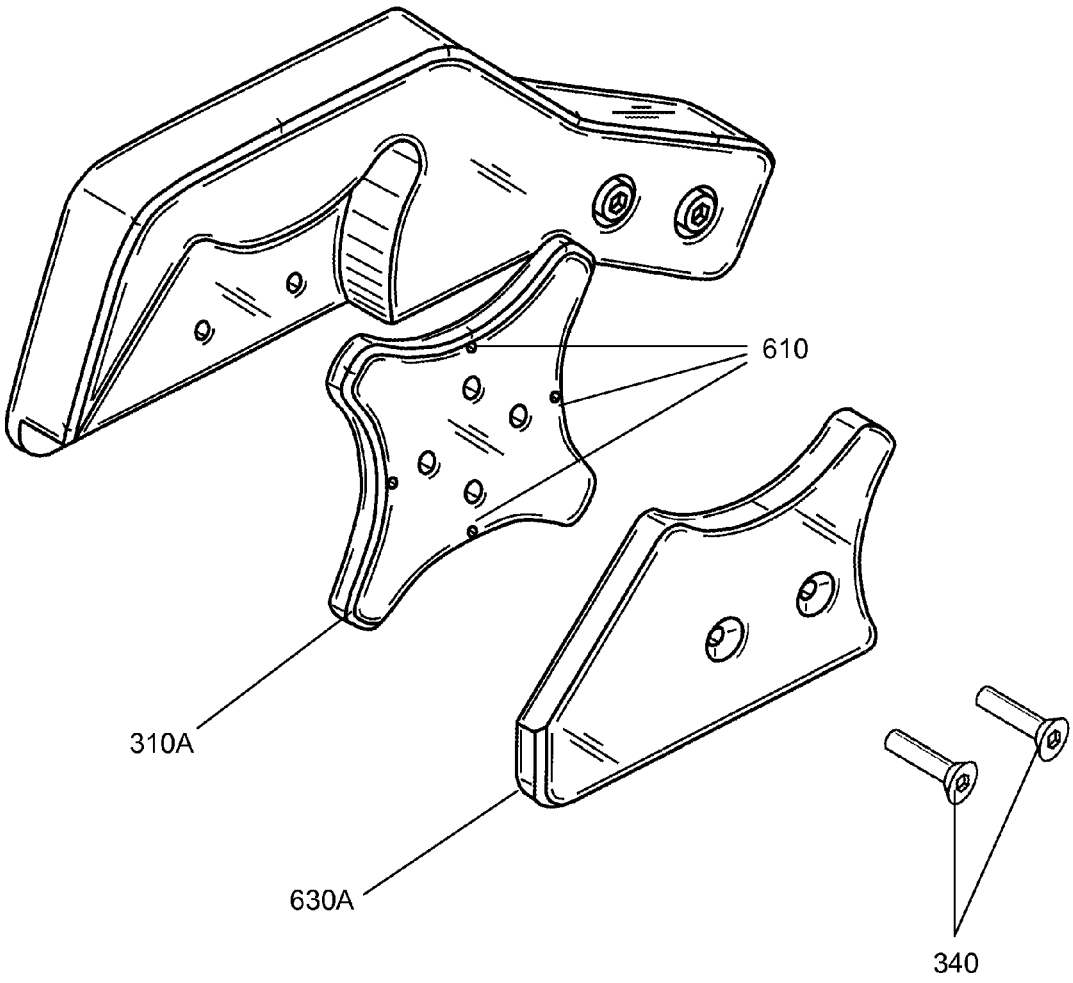
FIG. 10 is a diagram illustrating an embodiment depicting a further embodiment of the rotatable feature of the wear block.

FIG. 10 depicts an exemplary embodiment of a wear block in which four surfaces may be used by rotating about the central axis of a symmetric wear block 310A. As shown in the figure, wear block 310A may be held in place by wear block retaining plate 630A and further secured in place by screws 340. Wear indicator holes 610 may be disposed along each of the four wear surfaces. By rotating wear block 310A 90 degrees about the central axis, a total of four wear cycles may be provided.

Furthermore, by further flipping wear block 310A 180 degrees about its horizontal or vertical axes, the movement of the cable or rope is reversed relative to the already worn surfaces and an additional four wear cycles may be provided. Since the nature of the wear is predominantly at the entry point at the left edge in FIG. 10, the wear block 310A will wear at the edge on the left, or the edge closest to the entry point. Thus, by flipping the wear block 310A by 180 degrees as indicated, the wear block may provide an additional four wear cycles for each of the four surfaces when rotated about the central axis as described above. By rotating and flipping the wear block 310A in the manner described, a total of eight wear cycles may be provided before the wear block 310A must be completely replaced.

It will be understood that each of the elements described above, or two or more together may also find a useful application in other types of methods differing from the type described above. Although the more detailed examples provided above relate to traction sheaves in hoisting devices associated with elevated platforms for building maintenance, it should be apparent to one of ordinary skill in the art that the apparatus and methods described herein will find application to other systems that utilize traction sheaves. Additionally, the foregoing description has set forth various embodiments of the apparatus and methods via the use of diagrams and examples. While the present disclosure has been described in connection with the preferred embodiments of the various figures, it is to be understood that other similar embodiments may be used or modifications and additions may be made to the described embodiment for performing the same function of the present disclosure without deviating there from. Furthermore, it should be emphasized that a variety of applications, including marine and transportation systems, are herein contemplated. Therefore, the present disclosure should not be limited to any single embodiment, but rather construed in breadth and scope in accordance with the appended claims. Additional features of this disclosure are set forth in the following claims.

What is claimed:

1. An apparatus comprising:

a platform;

a hoisting machine mounted on the platform;

a rigging operable to raise and lower the platform, said rigging passing through a traction sheave mounted on the hoisting machine, said fraction sheave coupled to a restraint device, said restraint device located proximate to where said rigging passes through said traction sheave and positioned substantially at a position of maximum lifting of said rigging, wherein a gap is formed between an outer radius of said rigging and said restraint device such that the outer radius of said rigging is allowed to pass through said traction sheave while to limit lateral displacement of said rigging is limited;

wherein said restraint device comprises:

at least one removable attachment point for coupling said restraint device to said traction sheave;

a first edge operable for limiting said lateral displacement of said rigging; and a second edge opposite to the first edge, wherein the first and second edges approximate a contour of said traction sheave, said restraint device being substantially symmetrical in a major longitudinal axis such that said restraint device can be rotated about said longitudinal axis to present said second edge for limiting said lateral displacement;

wherein said first and second edges respectively have an indication of a degree of wear so that a user can flip the restraint device from the first edge to the second edge in order to replace the first edge which is indicating wear.

2. The apparatus of claim 1, wherein said restraint device is substantially symmetrical in an axis perpendicular to the major longitudinal axis such that the restraint device can be rotated around said axis perpendicular to the major longitudinal axis and coupled to said traction sheave to present third and fourth edges on said restraint device for limiting said lateral displacement.

3. The apparatus of claim 1, wherein said position of maximum lifting is approximately 120 degrees from a rigging entry point.

4. The apparatus of claim 1 wherein said indication of a degree of wear comprises of a second color or at least one hole.

5. A restraint device for restraining a rigging used with a traction sheave in a hoisting device, said restraint device operable for installation proximate to where said rigging passes through said traction sheave and substantially at a position of maximum lifting of said rigging, wherein a gap is formed between an outer radius of said rigging and said restraint device such that the outer radius of said rigging is allowed to pass through said traction sheave while lateral displacement of said rigging is limited;

wherein the restraint device comprises:

at least one removable attachment point for coupling the restraint device to said traction sheave;

a first edge operable for limiting said lateral displacement of said rigging; and a second edge opposite to the first edge, wherein the first and second edges approximate a contour of said traction sheave, said restraint device being substantially symmetrical in a longitudinal axis such that said restraint device can be rotated about said longitudinal axis to present said second edge for limiting said lateral displacement; and wherein said restrain device:

is substantially symmetrical in an axis perpendicular to the longitudinal axis such that the restraint device can be rotated around said axis perpendicular to the longitudinal axis and coupled to said traction sheave to present third and fourth edges of said restraint device which limit said lateral displacement of said rigging;

each of said edges are substantially identical in contour to one another; and each of said edges respectively has an indication of a degree of wear so that a user can flip the restraint device to any of said edges in order to replace one of said edges that is indicating wear.

6. The restraint device of claim 5, wherein said indication of a degree of wear comprises a second color.

7. The restraint device of claim 5, wherein said indication of a degree of wear comprises at least one hole.

* * * * *